US005685784A

United States Patent [19]

Butler

[11] Patent Number: 5,685,784

[45] Date of Patent: Nov. 11, 1997

[54] GOLF CLUB PUTTER HEAD

[76] Inventor: Byron Butler, 2 Siega, Rancho Santa Margarita, Calif. 92688

[21] Appl. No.: 697,077

[22] Filed: Aug. 19, 1996

[51] Int. Cl.[6] ..... A63B 53/04

[52] U.S. Cl. ..... 473/340; 473/255; 473/293; 473/313; 473/345

[58] Field of Search ..... 473/255, 268, 473/253, 254, 292, 293, 305, 313, 314, 324, 327, 329, 332, 340, 341, 345, 346, 350

[56] References Cited

U.S. PATENT DOCUMENTS

| | | | |
|---|---|---|---|
| D. 203,512 | 1/1966 | Solheim | 473/332 |
| 4,141,556 | 2/1979 | Paulin | 473/253 |
| 5,207,428 | 5/1993 | Aizawa | 473/346 |
| 5,275,412 | 1/1994 | Innes | 473/253 |
| 5,423,545 | 6/1995 | Narry | 473/253 |

*Primary Examiner*—William M. Pierce
*Attorney, Agent, or Firm*—Leonard Tachner

[57] ABSTRACT

A unique golf club putter head having an enlarged, substantially planar, slightly convex sole plate and a narrow bridge-like top member thereby lowering the center of gravity of the putter head. This lowered center of gravity is more readily exploited to achieve an accurate stroke by providing connection of the golf club shaft directly to the sole plate along the center-line of the putter head adjacent the face. This connection is facilitated by a hole in the top member bridge through which the hosel extends to receive the lower end of a shaft.

7 Claims, 4 Drawing Sheets

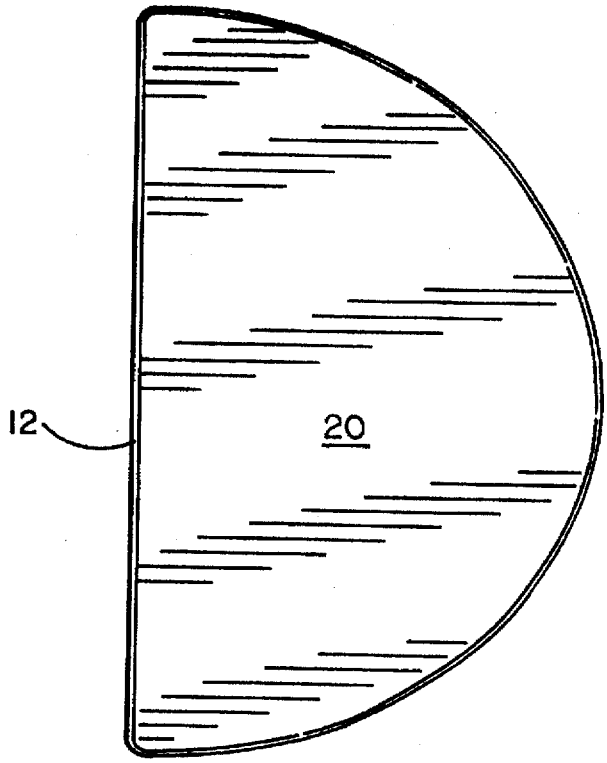
FIG. 4
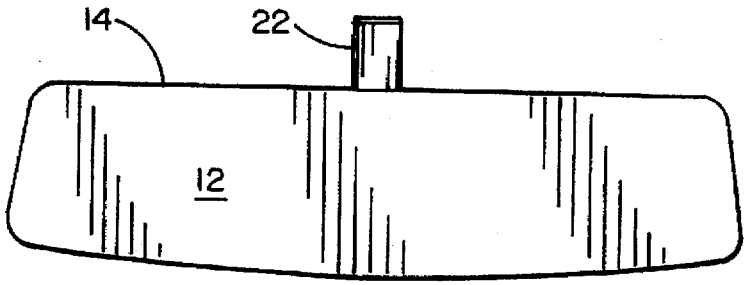
FIG. 5
FIG. 6
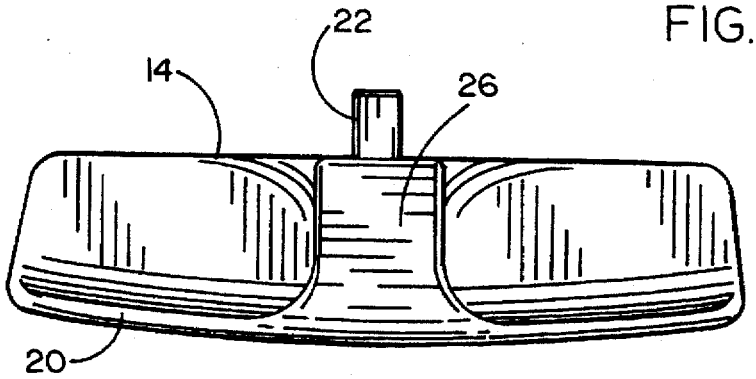

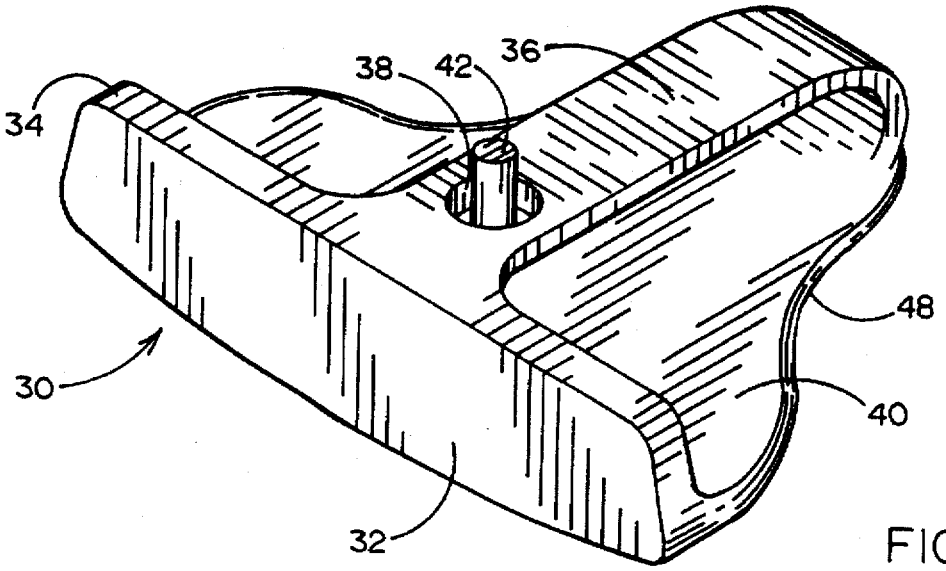
FIG. 7
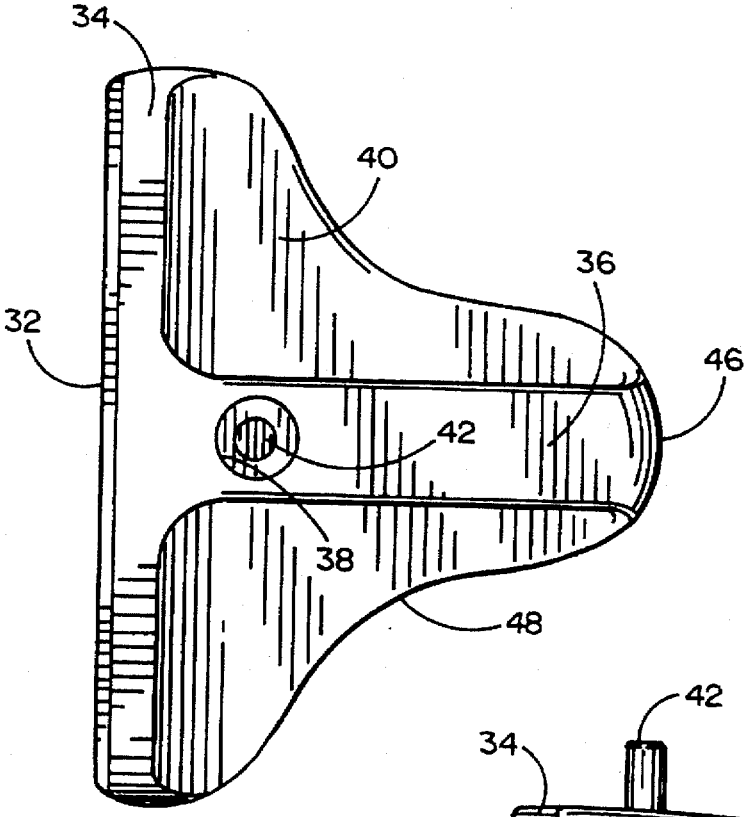
FIG. 8
FIG. 9
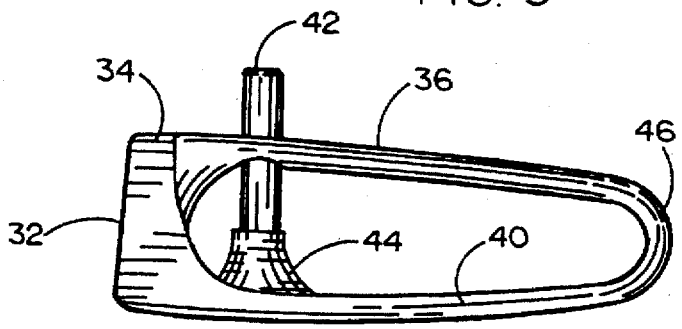

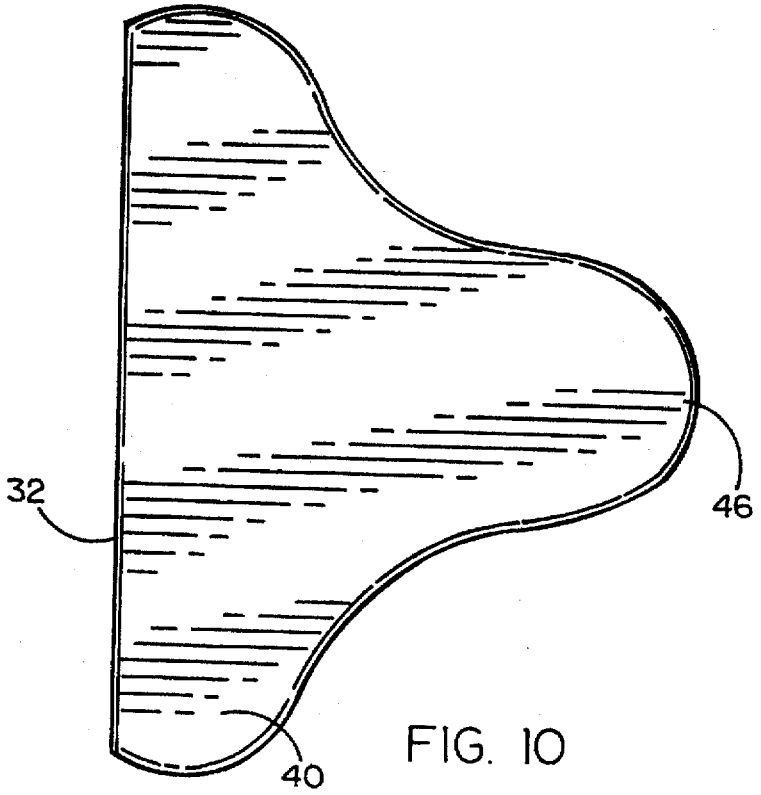
FIG. 10
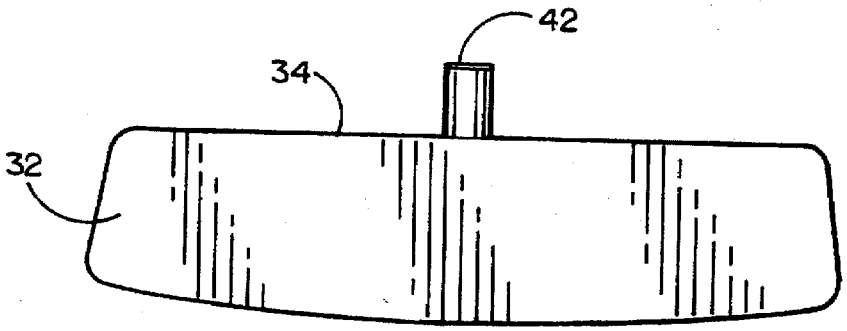
FIG. 11
FIG. 12
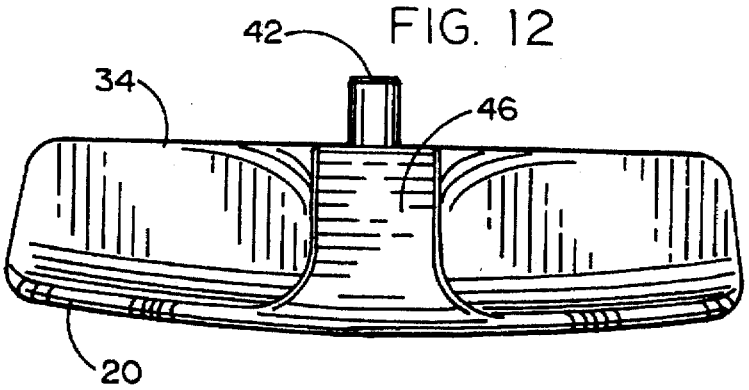

GOLF CLUB PUTTER HEAD

BACKGROUND OF THE INVENTION

1. Field of the Invention

The present invention relates generally to the field of golf clubs and more specifically to improved golf club putter heads having a unique shape that permits connection of a shaft directly to the sole plate providing more accurate control and improved weight distribution in an aesthetically pleasing configuration.

2. Prior Art

There are literally hundreds of U.S. Patents disclosing golf club putter heads. The following list is just a small sample of such patents.

| | |
|---|---|
| DES. 234,209 | Bizovi |
| DES. 248,181 | Cervantes |
| 1,517,476 | Tyler |
| 2,781,197 | Wiley |
| 3,043,596 | Ehmke |
| 3,199,872 | Taylor |
| 3,680,868 | Jacob |
| 4,000,902 | Perkins |
| 4,121,832 | Ebbing |
| 4,199,144 | Skelly |
| 4,484,746 | Brill |
| 4,746,124 | Comitz |
| 4,921,253 | Tesori |
| 4,960,279 | Harris, Jr. |
| 5,016,882 | Fujimura et al |
| 5,078,398 | Reed et al |

None of these patents discloses a putter head having a low center of gravity, a hosel connected directly to the sole plate, an enlarged sole plate and a bridge-like top surface having a hole for passing the hosel therethrough as will be seen hereinafter are some of the principal unique features of the invention.

SUMMARY OF THE INVENTION

The present invention comprises a unique golf club putter head having an enlarged, substantially planar, slightly convex sole plate and a narrow bridge-like top member thereby lowering the center of gravity of the putter head. This lowered center of gravity is more readily exploited to achieve an accurate stroke by providing connection of the golf club shaft directly to the sole plate along the center-line of the putter head adjacent the face. This connection is facilitated by a hole in the top member bridge through which the hosel extends to receive the lower end of a shaft. A lower center of gravity and a hosel connected to the sole plate along the head's centerline adjacent the face, reduces the tendency of inadvertent twisting which can occur in more conventional putter head designs having off-center hosels. In addition, the large, substantially planar sole plate and the low center of gravity keep the height of the hitting surface more consistently at a position more likely to be precisely aligned vertically with the ball to obtain a truer, more stable bounce-free roll toward the hole.

Two alternative configurations are disclosed herein. In one such configuration the sole plate is substantially a half oval shape while in the other such configuration the half-oval sole plate is modified by symmetrical concave notches slightly reducing the mass of the sole plate while retaining a symmetrical shape and a centered CG.

OBJECTS OF THE INVENTION

It is therefore a principal object of the present invention to provide an improved golf club putter head having a low center of gravity.

It is another object of the invention to provide an improved putter head having an enlarged sole plate.

It is still another object of the invention to provide an improved putter head having a hosel connected directly to the sole plate.

It is still another object of the invention to provide an improved putter head having a configuration which promotes consistently accurate ball strokes.

It is still another object of the invention to provide an improved putter head which has a unique and aesthetically pleasing shape.

BRIEF DESCRIPTION OF THE DRAWINGS

The aforementioned objects and advantages of the present invention as well as additional objects and advantages thereof will be more fully understood hereinafter as a result of a detailed description when taken in conjunction with the drawings in which:

FIG. 4 is a bottom view of the first embodiment;

FIG. 5 is a front view of the first embodiment;

FIG. 6 is a rear view of the first embodiment;

FIG. 7 is a three-dimensional view of a second embodiment of the invention;

FIG. 8 is a top view of the second embodiment;

FIG. 9 is a side view of the second embodiment;

FIG. 10 is a bottom view of the second embodiment;

FIG. 11 is a front view of the second embodiment;

FIG. 12 is a rear view of the second embodiment.

DETAILED DESCRIPTION OF A PREFERRED EMBODIMENT

Figure 1:
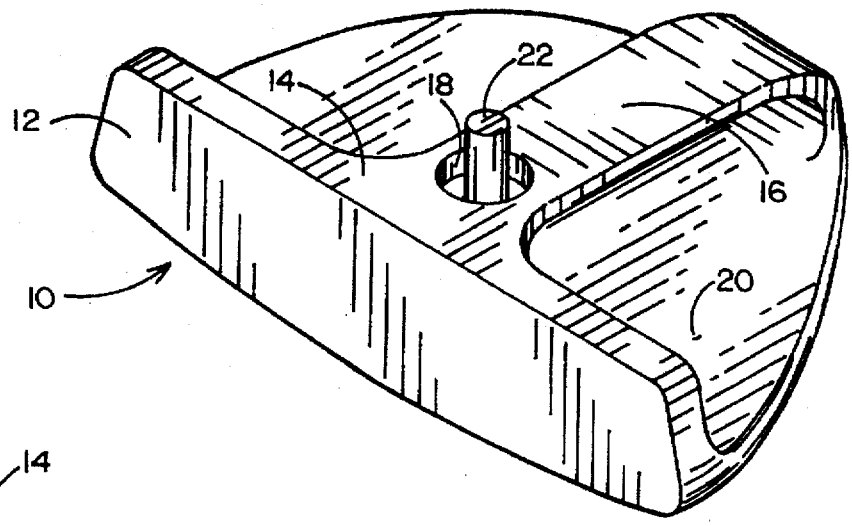
FIG. 1 is a three-dimensional view of a first embodiment of the invention.
Figure 2:
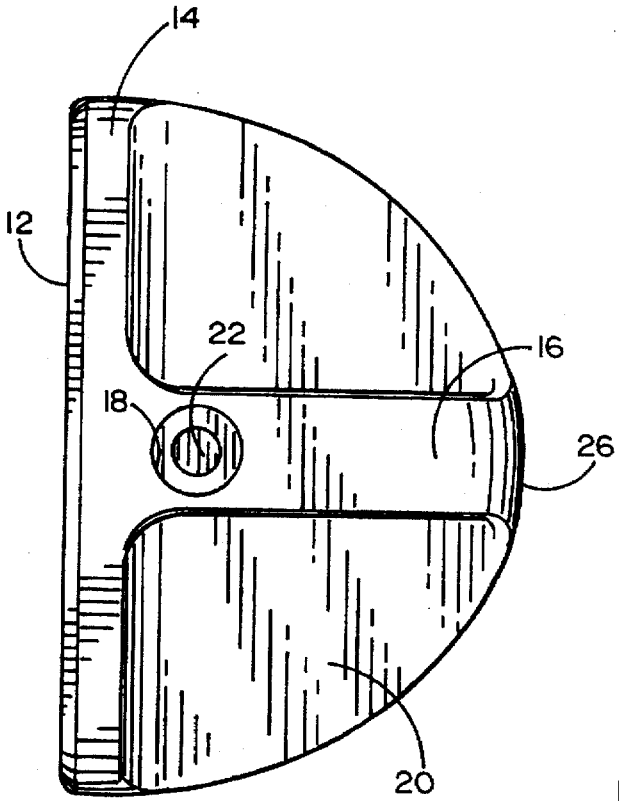
FIG. 2 is a top view of the first embodiment.
Figure 3:
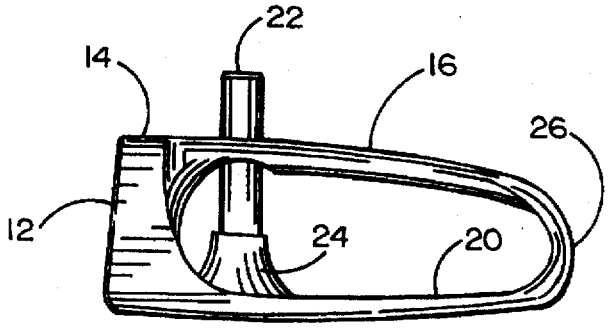
FIG. 3 is a side view of the first embodiment.

Referring to FIGS. 1–6, it will be seen that in accordance with a first embodiment of the present invention, a putter head 10 comprises a face or hitting surface 12, a top line 14, a bridge 16 through which there is a hole 18, a sole plate 20, a hosel 22, a hosel base 24 and a back surface 26. Various unique features may be readily observed. For example, sole plate 20 is relatively large for a putter head (the rearward extent of the sole plate is more than about 2.5 times the maximum height of the hitting surface), and bridge 16 is relatively small whereby to lower the center of gravity. Furthermore, the hosel 22 is connected at its base 24 directly to the sole plate 20 relatively close to the face 12 and extends through the hole 18 in the bridge 16 for receiving a shaft (not shown). The bottom surface of the sole plate 20 is preferably of a slightly domed or convex shape to reduce turf drag. The location of the hosel 22 provides a substantial balance between the mass in front of the shaft (i.e., the face 12 and top line 14) and the mass behind the shaft (i.e., the sole plate 20, the bridge 16 and the rear surface 26). As a result, a pendulum swing of the putter is more likely to be true and the center of gravity lies substantially along the axis of the shaft making it easier to strike the ball in a controlled manner in a desired direction. A low center of gravity that is also aligned with the shaft, combined with a relatively large surface area sole plate, provides an extremely stable and accurate putting stroke.

An alternative embodiment of the invention is disclosed in FIGS. 7–12. More specifically, a putter head 30 comprises a face or hitting surface 32, a top line 34, a bridge 36 through which there is a hole 38, a sole plate 40, a hosel 42, a hosel base 44 and a back surface 46. Unlike the sole plate 20 of the putter head 10 of FIGS. 1–6, the sole plate 40 provides a pair of symmetrical concave notches 48. These notches slightly reduce the mass of the sole plate of putter head 30 and thus move the center of gravity of the head forward in front of the shaft (not shown). Some golfers prefer a slight weight imbalance toward the ball-hitting surface. It will be readily apparent that the notches 48 may be made larger or smaller to further alter the position of the center of gravity toward or away from the face 12.

It will now be understood that what has been disclosed herein comprises a novel golf club putter head having a low center of gravity, an enlarged sole plate and a hosel connected directly to the sole plate, all of which results in a configuration which promotes consistently accurate ball strokes in a unique and aesthetically pleasing shape.

Those having skill in the art of golf club head design will now, as a result of the applicant's disclosure herein, perceive various additions and modifications which may be made to the invention. By way of example, the relative depth and height of the center of gravity may also be altered by changing the width and thickness of the bridge between the top line and the rear surface. Accordingly, all such additions and modifications are deemed to be within the scope of the invention which is limited only by the appended claims and their equivalents.

I claim:

1. A golf club putter head comprising:

a ball-hitting face surface extending in height between a sole plate and a top surface;

a substantially planar sole plate extending rearwardly of said ball-hitting face surface to a rear surface;

a bridge member separated from said sole plate and extending rearwardly of said ball-hitting surface from said top surface to connect to said rear surface; the dimensions of said bridge member being substantially less than the dimensions of said sole plate for lowering the center of gravity of said head toward said sole plate; said bridge member having a hole therethrough for passing a hosel; and a hosel extending from said sole plate through said bridge member hole for receiving a shaft.

2. The putter head recited in claim 1 wherein said hole in said bridge member is substantially adjacent said ball-hitting face surface.

3. The putter head recited in claim 1 wherein the distance between said ball-hitting face surface and said rear surface is at least about 2.5 times the maximum height of said ball-hitting face surface.

4. The putter head recited in claim 1 wherein said sole plate comprises an upper surface and a lower surface and wherein said upper surface is substantially planar and said lower surface is convex.

5. The putter head recited in claim 1 wherein said sole plate comprises a pair of symmetrically located concave notches.

6. The putter head recited in claim 1 wherein said sole plate is shaped substantially as a half-oval.

7. The putter head recited in claim 1 wherein said rear surface is arcuately shaped to form a smooth, curved transition between said bridge member and said sole plate.

* * * * *